US006284095B1

(12) United States Patent
Lebel et al.

(10) Patent No.: US 6,284,095 B1
(45) Date of Patent: Sep. 4, 2001

(54) MINIMIZATION OF MALODOROUS GAS RELEASE FROM A CELLULOSE PULP MILL FEED SYSTEM

(75) Inventors: David J. Lebel; Todd S. Grace, both of Queensbury, NY (US)

(73) Assignee: Andritz-Ahlstrom Inc., Glens Falls, NY (US)

( * ) Notice: Subject to any disclaimer, the term of this patent is extended or adjusted under 35 U.S.C. 154(b) by 0 days.

(21) Appl. No.: 09/483,021

(22) Filed: Jan. 14, 2000

Related U.S. Application Data

(60) Provisional application No. 60/118,697, filed on Feb. 4, 1999.

(51) Int. Cl.[7] ..... D21C 7/12

(52) U.S. Cl. ..... 162/17; 162/47; 162/52; 162/246

(58) Field of Search ..... 162/17, 52, 246, 162/248, 254, 47

(56) References Cited

U.S. PATENT DOCUMENTS

| | | | | |
|---|---|---|---|---|
| 4,897,157 | * | 1/1990 | Elmore et al. | 162/240 |
| 4,958,741 | | 9/1990 | Johanson | 220/83 |
| 5,476,572 | | 12/1995 | Prough | 162/246 |
| 5,500,083 | | 3/1996 | Johanson | 162/17 |
| 5,617,975 | | 4/1997 | Johanson et al. | 222/185.1 |
| 5,622,598 | | 4/1997 | Prough | 162/52 |
| 5,628,873 | | 5/1997 | Johanson et al. | 162/17 |
| 5,635,025 | | 6/1997 | Bilodeau | 162/17 |
| 5,700,355 | | 12/1997 | Prough | 162/246 |
| 5,736,006 | | 4/1998 | Prough | 162/52 |
| 5,753,075 | | 5/1998 | Stromberg et al. | 162/52 |
| 5,766,418 | | 6/1998 | Prough | 162/246 |
| 5,795,438 | | 8/1998 | Stromberg et al. | 162/52 |
| 5,865,948 | * | 2/1999 | Lora et al. | 162/19 |

OTHER PUBLICATIONS

"Thermocompressors", from www.foxvalve.com, 1999.*

Northeast Inc. online "Venturi Products", www.nciweb.net, 1999.

* cited by examiner

*Primary Examiner*—Dean T. Nguyen
(74) *Attorney, Agent, or Firm*—Nixon & Vanderhye P.C.

(57) ABSTRACT

The release of malodorous TRS-containing gases from a comminuted cellulosic fibrous material feed system for a digester is minimized utilizing a particular arrangement associated with a pressure isolation device. Material is fed through the pressure isolation device and the pressure of the material increases from the inlet to the outlet, and the material is discharged from the pressure isolation device into a treatment vessel, such as a horizontal steaming vessel. Malodorous gases from the pressure isolation device are discharged substantially independently of the material discharged from the isolation device, and at least some of the malodorous gases discharged from the pressure isolation device are pressurized (e.g. in an eductor or thermocompressor) and reintroduced into the flow of cellulosic material downstream of the pressure isolation device (for example into the horizontal steaming vessel or a vessel downstream of it). In the horizontal steaming vessel the gases can be removed from a top portion thereof and fed to an NCG system associated with the pulp mill.

22 Claims, 4 Drawing Sheets

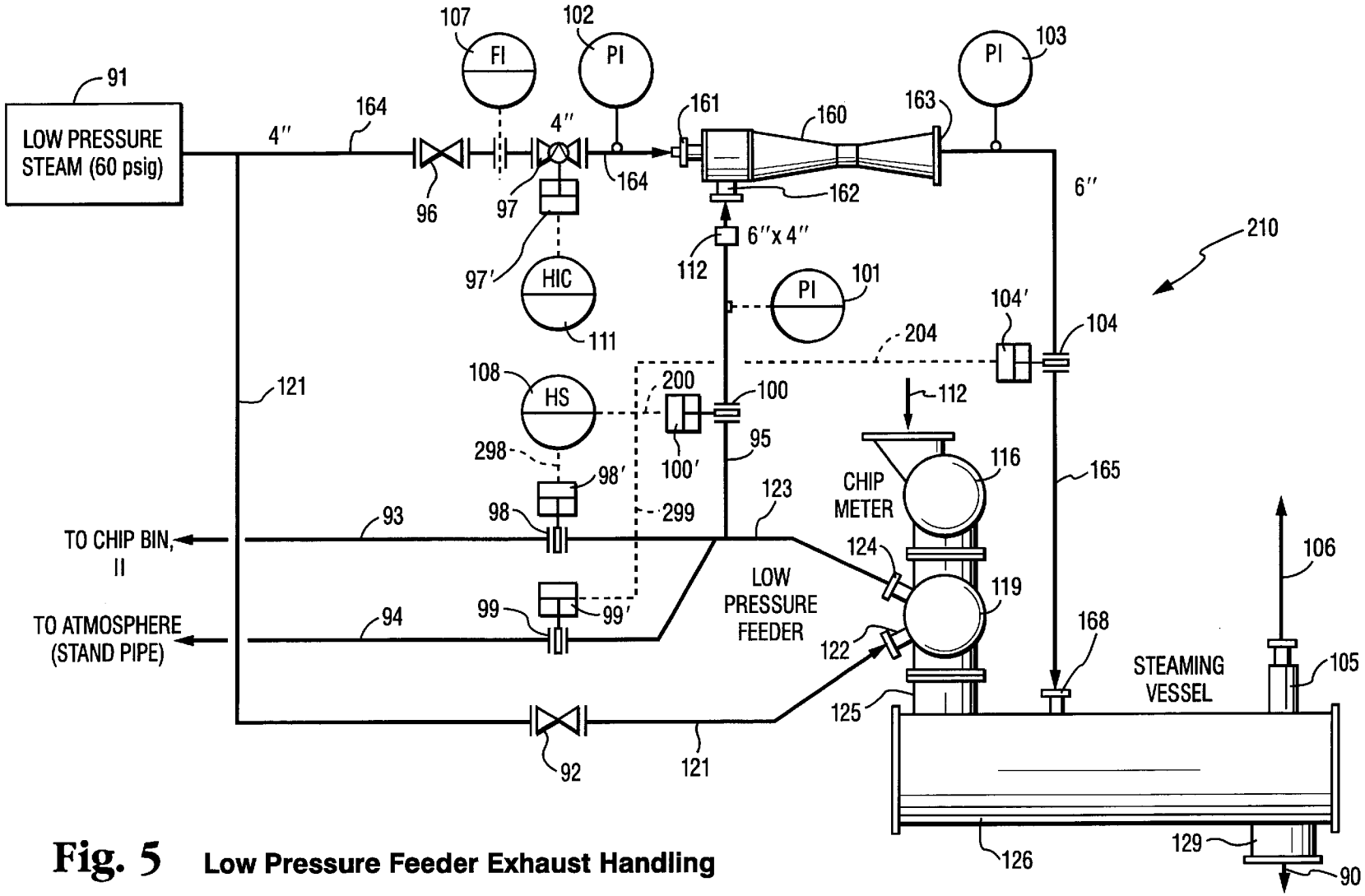
Fig. 5 Low Pressure Feeder Exhaust Handling

MINIMIZATION OF MALODOROUS GAS RELEASE FROM A CELLULOSE PULP MILL FEED SYSTEM

CROSS-REFERENCE TO RELATED APPLICATION

This application claims the priority of provisional application Ser. No. 60/118,697 filed Feb. 4, 1999.

BACKGROUND AND SUMMARY OF THE INVENTION

The term "chemical pulping" applies to the process of treating comminuted cellulosic fibrous material, for example, hardwood or softwood chips, with an aqueous solution of chemicals which dissolve the non-cellulose components of the material, and some of the cellulose components, to produce a slurry of cellulose fibers that can be used to produce cellulose paper products. The commercially significant chemical pulping process in the late twentieth century is the alkaline process, a process more commonly referred to as the "kraft" process. In the kraft process, the active chemicals with which the wood is treated are sodium hydroxide [NaOH] and sodium sulfide [$Na_2S$]. The aqueous solution of sodium hydroxide and sodium sulfide is referred to as "kraft white liquor".

Kraft pulping is typically performed at a temperature of over 100° C., and the process is typically performed under superatmospheric pressure, preferably 5–10 bar, in a sealed pressure-resistant vessel known in the art as a digester. Typically, the cellulose material is sequentially raised to this treatment temperature and pressure, and cooking chemical is introduced to the material, in a series of steps that take place in what is known in the art as the "feed system".

In the case of a continuous digester in which material is continuously introduced at one end and discharged at the other, the feed system typically comprises or consists of several vessels for heating the material, raising its pressure, and introducing cooking liquid. For instance, continuous cooking feed systems typically include some form of chip bin into which the comminuted cellulosic fibrous material, referred to hereafter as "wood chips" (the most common form), are first introduced. This chip bin typically includes some form of isolation device at its inlet to prevent the escape of gases from the bin. The bin may also include an exhaust outlet for releasing the gases that may accumulate in the bin. Typically, treatment of the chips begins in the chip bin when the chips are exposed to high temperature steam. The steam begins the heating process, but, more importantly, the steam displaces the air in the chips so that the air content of chips is minimized. This removal of air and other gases from the chips promotes the "sinking" of the chips during subsequent aqueous treatment.

After steaming in the chip bin, the de-aerated chips are discharged from the chip bin by some form of metering device, for example, a Chip Meter sold by Ahlstrom Machinery Inc., of Glens Falls, N.Y. or a metering screw or any other form of conventional metering device. After discharge from the chip bin and metering device, the pressure of the chip mass is increased from approximately atmospheric pressure to a pressure of about 18 psi. This is typically achieved by a pressure isolation device, for example, a Low Pressure Feeder [LPF] as sold by Ahlstrom Machinery. The LPF is a device having a rotating star-type rotor within a stationary housing having an inlet and an outlet. Typically, as the rotor turns in the housing, chips drop through the inlet into the pockets of the rotor. As the rotor turns toward the outlet, the chips are exposed to a higher pressure and the chips fall through the outlet of the LPF to further treatment below. The clearance between the tines of the rotor and the inside surface of the housing is closely toleranced so that the higher pressure typically below the LPF does not escape to the area of lower, atmospheric pressure above and around the LPF.

The LPF typically includes some form of steam purge to purge the rotor cavities of chips during and after the chips are discharged from the outlet of the feeder. This purge usually comprises or consists of low-pressure steam introduced to a port in the housing of the feeder. The LPF also typically includes some form of exhaust gas relief port to release any gases that may accumulate in the feeder such that these typically pressurized gases are not introduced to the inlet of the feeder where they can interfere with the flow of chips into the feeder or interfere with the flow of chips through the metering device or chip bin above.

In conventional feed systems, the LPF discharges chips to the pressurized atmosphere of another treatment vessel. Conventionally, this vessel typically performs a further treatment of the chips with steam under a pressure of about 18 psi. This conventional pressurized steaming typically removes any further air that may be present and also increases the temperature of the chips to about 120° C. prior to being immersed in cooking liquor. One preferred treatment vessel for performing this pressurized steam treatment is a Steaming Vessel as sold by Ahlstrom Machinery. The Steaming Vessel is most often a horizontally-oriented vessel having a cylindrical housing and horizontal screw conveyor. Steam is added to the housing through one or more ports typically located on the bottom of the housing. The source of this steam is typically flashed spent cooking liquor. That is, hot cooking liquor removed from the cooking process in the digester is expanded under controlled conditions by exposing the liquor to a pressure lower than its boiling point. In addition to generating steam from the flashed liquor, other volatile, typically malodorous, gases are also generated in the flashing process, such as hydrogen sulfide [$H_2S$], methyl mercaptan [$CH_3SH$], dimethyl sulfide [$CH_3SCH_3$], and dimethyl disulfide [$CH_3SSCH_3$], as well as other often malodorous gases. These gases, which are referred to collectively as Total Reduced Sulfur gases or TRS gases, are typically also introduced to the chips in the pressurized steaming process, typically in a Steaming Vessel.

Gases are also introduced to the Steaming Vessel from the outlet of the vessel which typically discharges to a vertical conduit or chute leading to a transfer device. For example, the outlet of the Steaming Vessel may discharge chips to a conduit leading to a star-type feeding device, for example, a High Pressure Feeder (HPF) sold by Ahlstrom Machinery, or to a slurry-type pump, for example, a LO-LEVEL® pump also sold by Ahlstrom Machinery. The conduits leading to these devices typically contain liquids containing sulfur compounds which also contribute TRS gases to the Steaming Vessel. Thus, the vessel below the LPF typically contains pressurized gases containing TRS compounds.

As a result, the outlet of the LPF typically is exposed to pressurized gases containing TRS compounds. These gases, if left unchecked, can be carried by the rotation of the LPF to the inlet of the LPF and released to the metering device and chip bin above. In addition, as discussed above, some LPF devices also include an exhaust port for discharging any accumulated gases from the LPF housing. Again, these TRS gases can typically be re-introduced upstream, for example, in the chip bin, and collected in the chip bin gas relief conduit. In conventional systems, this gas relief is directed to the Non-Condensable Gas (or NCG) collection system for destruction or re-use.

However, some pulp mills, typically older pulp mills, either do not have an NCG collection system or have an NCG collection system of limited capacity. Therefore, in such mills, it is undesirable to vent the TRS-laden gas streams in and around the LPF to the chip bin or to NCG treatment. In such systems, it is more desirable to re-introduce the TRS-laden streams to the feed system in a manner and form that does not allow the gases to escape to the atmosphere or be introduced to the NCG system. The present invention addresses this problem by removing the TRS-laden gases from the feed system and reintroducing these gases at a location downstream from where they were removed so that little or no TRS-laden gases are released to the atmosphere or must be treated or destroyed.

The broadest embodiment of this invention comprises or consists of a method and apparatus for minimizing the release of malodorous, TRS-containing gases from a pulp mill having a digester system and a feed system which feeds material to the digester system, wherein the method consists of or comprises the following steps: (a) introducing comminuted cellulosic fibrous material to the feed system; (b) exposing the material in the feed system to a pressurized gas containing TRS compounds, the gas having a first pressure; (c) removing the gas from the feed system at a first location; (d) pressurizing the gas and re-introducing the gas at a point downstream of said first location; and (e) discharging the material from the feed system and passing the material to the digester system for further treatment.

The digester system may be one or more continuous or batch digesters. The feed system typically includes one or more steam treating vessels, such as a Chip Bin or Streaming Vessel; one or more pressure isolation devices, such as a Low-pressure Feeder or High-pressure Feeder; and material transfer vessels, such as a Chip Chute or Chip Tube, and steps (b) and c) are practiced in one or more of these devices. The pressurization of step (d) is typically practiced using a thermocompressor, eductor, ejector, vacuum pump, compressor, or like device. Step (d) may be practiced by introducing the pressurized gas to any downstream location that can economically accommodate the introduction of a gas stream without interfering with the intended operation of the feed system or digester system. For example, the pressurized gas of step (d) may be introduced to the feed system, specifically to Steaming Vessel, Chip Tube, or Chip Chute; or the pressurized gas may be introduced to the digester system, specifically to a flash tank, condenser, or digester vessel, for example, to the top of a steam-phase digester vessel.

Another embodiment of this invention comprises or consists of a method and apparatus for capturing and re-introducing malodorous, TRS-containing, gases from a comminuted cellulosic fibrous material feed system without allowing the gases to escape to the environment. In the preferred embodiment, the method comprises transferring comminuted cellulosic fibrous material in a digester feed system having an isolation device followed by a treatment vessel containing malodorous gases, wherein the method consists of or comprises the following steps: (a) introducing comminuted cellulosic fibrous material at a first pressure to the inlet of a pressure isolation device; (b) transferring the material to the outlet of the device at a second pressure, higher than the first pressure; (c) discharging the material to the treatment vessel; (d) discharging malodorous gases that enter the isolation device from the isolation device; and (e) pressurizing at least some of the malodorous gases discharged from the isolation device to increase the pressure thereof (e.g. at least by 2 psig); and (f) re-introducing the pressurized malodorous gases to the cellulosic material flow (e.g. feed system or vessels) downstream of the pressure isolation device.

This disclosure also relates to a method and apparatus for minimizing the release of malodorous, TRS-containing, gases from a comminuted cellulosic fibrous material feed system having a pressure isolation device having an inlet and outlet and a treatment vessel connected to the outlet. The method comprises or consists of: (a) introducing comminuted cellulosic fibrous material at a first pressure to the inlet of a pressure isolation device; (b) transferring the material to the outlet of the device at a second pressure, higher than the first pressure; (c) discharging the material to the treatment vessel; (d) discharging the malodorous gases that enter the isolation device; and (e) introducing steam to the outlet of the isolation device to minimize or prevent the passage of malodorous gases from the treatment vessel through the housing of the isolation device.

There is provided a method of minimizing the release of malodorous TRS-containing gases from a comminuted cellulosic fibrous material feed system having a pressure isolation device with an inlet and outlet, and a treatment vessel connected to the outlet, the method comprising: (a) Introducing comminuted cellulosic fibrous material at a first pressure to the inlet of the pressure isolation device. (b) Transferring the material to the outlet of the pressure isolation device at a second pressure, higher than the first pressure. (c) Discharging the material from the pressure isolation device to the treatment vessel. (d) Introducing steam to the pressure isolation device to minimize or prevent the passage of malodorous gases into the treatment vessel through the pressure isolation device. And, (e) discharging malodorous gases from the pressure isolation device substantially independently of the discharge of comminuted cellulosic fibrous material therethrough.

The invention also consists of or comprises a method of minimizing the release of malodorous TRS-containing gases from a comminuted cellulosic fibrous material feed system, said method comprising: (a) Providing comminuted cellulosic fibrous material at a first pressure in the feed system and ultimately discharging the comminuted cellulosic material from the feed system. (b) Discharging malodorous gases from the feed system at a gas discharge point, substantially independently of the discharge of comminuted cellulosic fibrous material therefrom. (c) Pressurizing at least some of the malodorous gas discharged in (b) to increase the pressure thereof. And, (d) re-introducing the pressurized gas from (c) into the flow of comminuted cellulosic material downstream of the gas discharge point.

Typically (d) is practiced by reintroducing the malodorous gases into a treatment vessel connected to the outlet of the feed system, e.g. in a horizontal steaming vessel. The method may also further comprise (e) steaming the material in the horizontal steaming vessel, and discharging steamed material from the horizontal steaming vessel from a bottom portion thereof; (f) discharging malodorous gases from a top portion of the horizontal steaming vessel adjacent the bottom portion thereof from which the material is discharged; and (g) treating or disposing of the gases from (f) in an NCG system. Also the method may further comprise (h) directing or diverting the flow of gases from (b) to at least one of: (i) a chip bin operatively connected to the inlet of the pressure isolation device, (ii) atmosphere; and (iii) a pressurizing device which pressurizes the gases. For example (h) may be practiced by manual actuation causing a plurality of valves to be moved which control the passage of gas through conduits connected to the chip bin, to atmosphere, and to the pressurizing device.

Preferably (d) is practiced to increase the pressure of the gases to between about 11–31 psig, and at least one psig higher than the pressure in the vessel into which the gases are introduced, for example, the treatment vessel, or to at least increase the pressure by at least 2 psig.

According to another aspect of the present invention there is provided a method of minimizing the release of malodorous TRS-containing gases from a comminuted cellulosic fibrous material feed system having a pressure isolation device with an inlet and outlet, and a treatment vessel connected to the outlet, the method comprising: (a) Introducing comminuted cellulosic fibrous material at a first pressure to the inlet of the pressure isolation device. (b) Transferring the material to the outlet of the pressure isolation device at a second pressure, higher than the first pressure. (c) Discharging the material from the pressure isolation device to the treatment vessel. (d) Discharging malodorous gases from the pressure isolation device substantially independently of the discharge of comminuted cellulosic fibrous material therethrough. (e) Pressurizing at least some of the malodorous gases discharged in (d). And, (f) re-introducing the pressurized malodorous gases downstream of the pressure isolation device. Step (f) is preferably practiced by introducing the malodorous gases to the treatment vessel, but may be practiced by introducing the gases to any vessel downstream of the pressure isolation device. The method may further comprise screening the gases passing out of the pressure isolation device during (d) to substantially prevent the passage of chips, pins, or fines out of the pressure isolation device with the malodorous gases.

According to another aspect of the present invention a feed system for a digester (either a continuous digester or a plurality of batch digesters) in a pulp mill is provided. The feed system preferably comprises: A pressure isolation device having an inlet into which comminuted cellulosic fibrous material is fed at a first pressure, and an outlet from which the material is discharged at a second pressure, greater than the first pressure. A superatmospheric pressure treatment vessel having a material inlet connected to the outlet of the pressure isolation device, and a material outlet. A gas discharge outlet from the pressure isolation device separate and distinct from the material discharge outlet. A conduit connected to the gas discharge outlet. And a pressurizing device, which pressurizes gases, connected to the conduit. Also if desired there may be a screen at the gas discharge outlet for screening chips, pins and fines out of gas being discharged through the outlet.

The feed system may further comprise a pressurized fluid introduction port in the pressure isolation device, the port remote from the gas discharge outlet and closer to the material discharge outlet of the pressure isolation device than is the gas discharge outlet, and a screen at the gas discharge outlet for screening chips, pins and fines out of gas being discharged through the outlet. Preferably the pressurizing device comprises a thermocompressor or an eductor, connected to a source of steam providing a source of pressurizing fluid therefor. Typically a discharge of steam and pressurized gases from the thermocompressor or eductor is fed to the superatmospheric pressure treatment vessel at a point downstream of the pressure isolation device. For example the superatmospheric pressure treatment vessel comprises a horizontal steaming vessel; and the feed system further comprises a gas outlet from the horizontal steaming vessel operatively connected to an NCG system, the gas outlet downstream of the point at which the discharge of steam and pressurized gases is connected to the horizontal steaming vessel.

A plurality of conduits may be operatively connected to the gas discharge outlet and a manually or automatically operated valve controller provided to control the valves in the plurality of conduits. One of the conduits may lead to a chip bin operatively connected to the inlet of the pressure isolation device (e.g. through a chip meter), another conduit may lead to the atmosphere (e.g. a standpipe), the third conduit may lead to a pressurizing device which pressurizes gases.

It is the primary object of the present invention to provide an effective system and method for handling exhaust gases so as to minimize the potential for pollution from those exhaust gases. This and other objects of the invention will become clear from an inspection of the detailed description of the invention and from the appended claims.

BRIEF DESCRIPTION OF THE DRAWINGS

FIG. 5 is a side schematic view of another exemplary embodiment of the feed system according to the present invention.

DETAILED DESCRIPTION OF THE DRAWINGS

Figure 1:
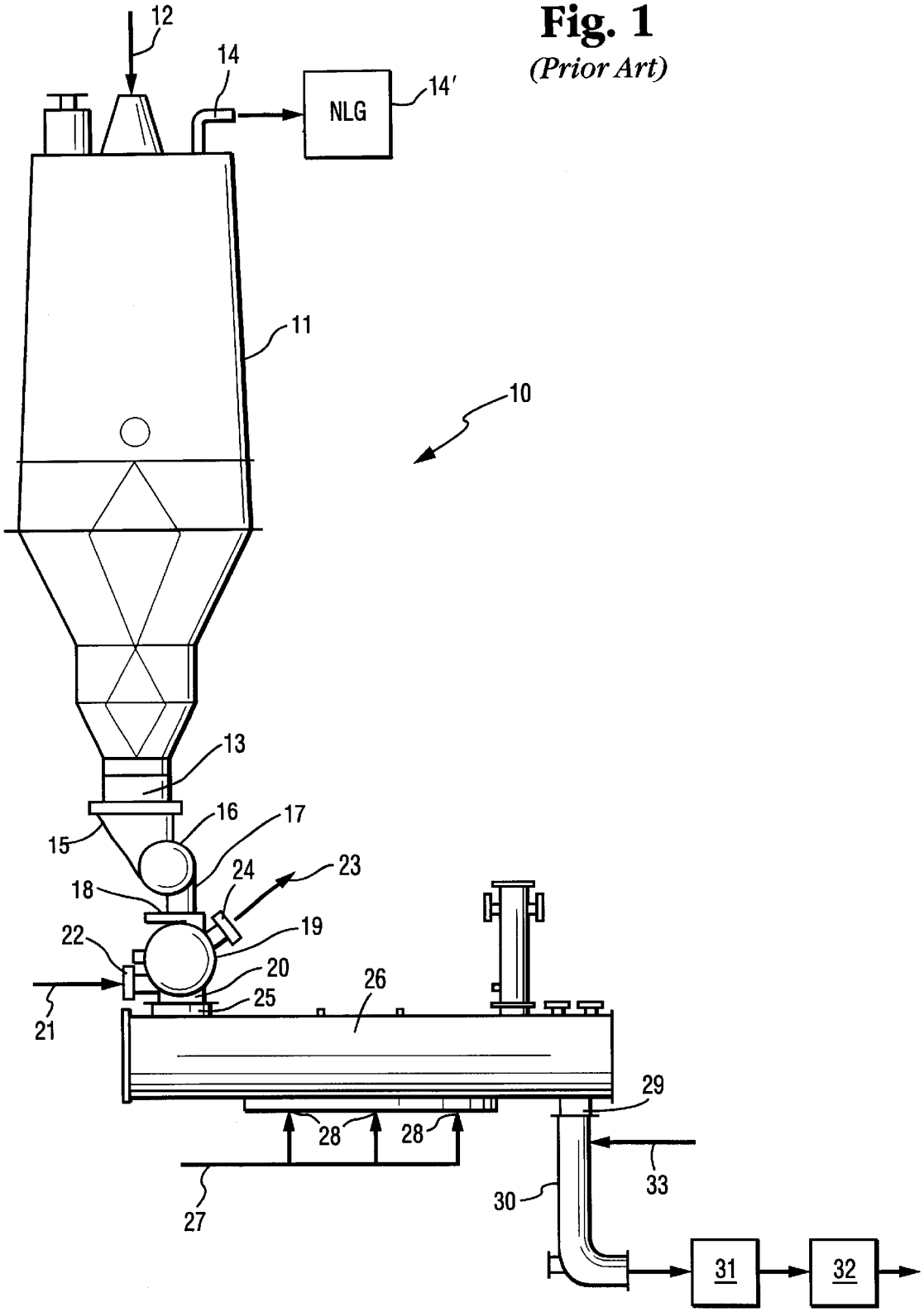
Fig. 1 (Prior Art)
FIG. 1 is a schematic view of an exemplary prior art feed system for a pulp mill.

FIG. 1 illustrates one prior art feed system 10 over which the present invention is an improvement. System 10 comprises or consists of a comminuted cellulosic fibrous material retention vessel, or chip bin, 11, having an inlet for wood chips, and an outlet 13. Bin 11 also may include a gas discharge vent 14, e.g. connected to an NCG collection system 14'. Though the bin shown is a DIAMONDBACK® bin, having single-convergence and side relief geometry, marketed by Ahlstrom Machinery, the present invention is applicable to any type of chip bin including a conventional bin having a vibrating discharge, often referred to as a VIBRABIN™ discharge as sold by the company Vibrascrew. The inlet 12 typically includes some form of isolation device to isolate the gases in the bin from the atmosphere. The pressure in the bin is typically about atmospheric, that is, less than 10 psi gage.

The outlet 13 of bin 11 is connected to the inlet 15 of metering device 16. The metering device may be any form of conventional metering device, such as a metering screw, but is preferably a star-type metering device such as Ahlstrom Machinery's Chip Meter or its equivalent. The metering device 16 has an outlet 17 connected to the inlet 18 of a pressure isolation device 19, having an outlet 20. The isolation device 19, again, may be any type of conventional isolation device, but is preferably a star-type Low Pressure Feeder (LPF) pressure isolation device, as sold by Ahlstrom Machinery. The outlet 20 is typically pressurized to a pressure between 10 and 20 psi, preferably about 18 psi gage. The pressure isolation device 19 typically includes a steam purge 21 introduced through inlet 22 and an exhaust relief 23 from outlet 24. The outlet of the isolation device 20 discharges to the inlet 25 of treatment vessel 26, which is pressurized to about 10–20 psi gage.

Treatment vessel 26 may be any type of treatment vessel, but is preferably a Steaming Vessel, as sold by Ahlstrom Machinery, having a horizontal screw conveyor (not shown). Low pressure steam 27, that is, steam at a pressure of between 10 and 100 psi gage is introduced to vessel 26. For example, if flashed steam is used, the steam pressure typically varies between 10 to 30 psi gage, preferably between 15 and 25 psi gage. If fresh steam is used, the steam pressure may typically vary from 30 to 80 psi gage, preferably from 40 to 70 psi gage. Regardless of the source and pressure of the steam, it is typically introduced to vessel 26 via one or more ports 28 to treat the material. After completion of treatment in vessel 26 the treated material is discharged from the outlet 29 of vessel 26 to a conduit 30. Treatment liquid, for example, kraft white liquor or black liquor, is introduced to the material in conduit 30 via conduit 33 such that a slurry of material and liquid is provided in conduit 30. Conduit 30 transfers the treated slurry by gravity to the inlet of transfer device 31 which pressurizes and transfers the slurry to an impregnation vessel or to a continuous or batch digester 32. Transfer device 31 may be a conventional High Pressure Feeder type device, as sold by Ahlstrom Machinery, or it may be one or more slurry pumps or a combination High Pressure Feeder and slurry pump as marketed under the name LO-LEVEL® by Ahlstrom Machinery as described in U.S. Pat. Nos. 5,476,572; 5,622,598; 5,635,025; 5,736,006; 5,753,075; 5,766,418; and 5,795,438. The conduit 30 may be a Chip Chute or a Chip Tube as sold by Ahlstrom Machinery.

Figure 2:
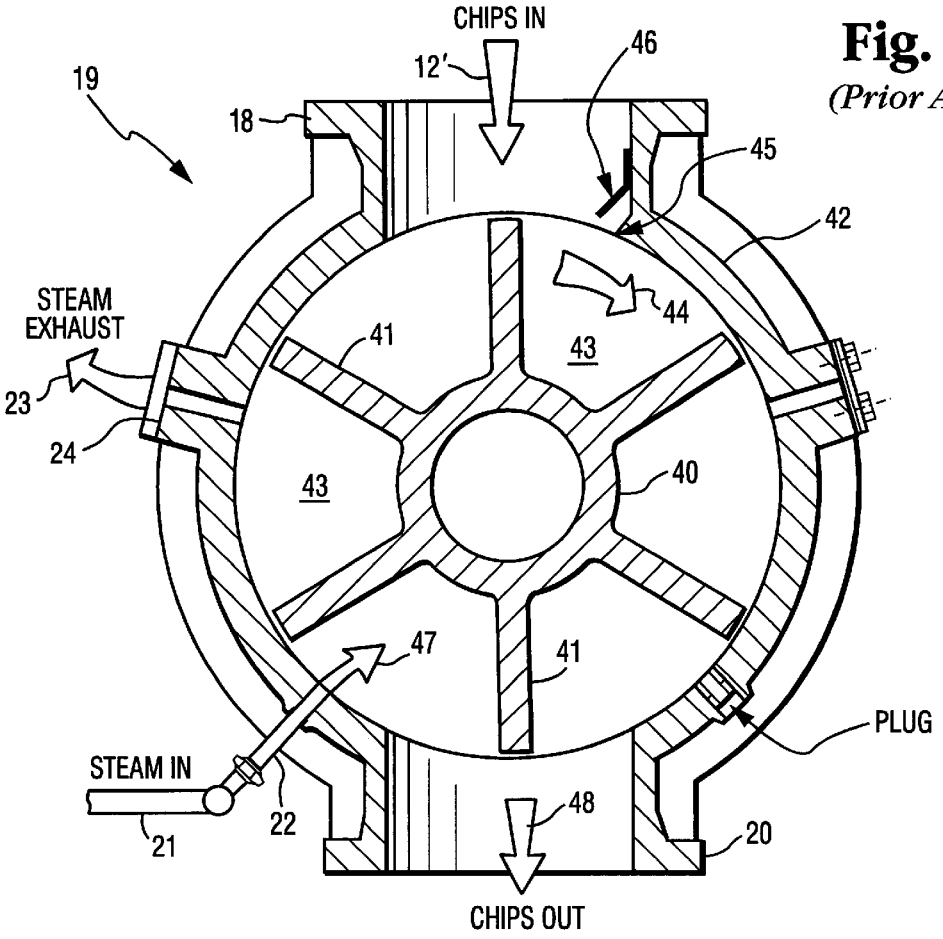
Fig. 2 (Prior Art)
FIG. 2 is a schematic cross-sectional view of an exemplary conventional low pressure feeder.

FIG. 2 is a schematic cross-sectional view of one typical isolation device 19, shown in FIG. 1, that can be used according to the present invention. The device shown is Low Pressure Feeder sold by Ahlstrom Machinery. The device includes a pocketed, star-type rotor 40 having arms or tines 41 and pockets 43 and a housing 42 having an inlet 18 and outlet 20. The rotor turns in the direction of arrow 44. FIG. 2 also illustrates a typical sharply profiled "shear edge", 45, and a deflection baffle or "doctor blade", 46. As the pockets 43 fill with chips and then rotate in the direction of arrow 44, the shear edge, 45, "trims off" the top of the chip mass. The doctor blade, 46, acts as a deflector to prevent large chips or tramp material from impinging on the shear edge.

In operation, chips 12' fall into inlet 18 from the metering device 16 above (see FIG. 1). The prevailing pressure at the inlet 18 may vary from 0–1 bar (0–15 psi) gage (or a slight vacuum may exist ). After entering the inlet 18, the chips fall into pockets 43. The chips 12' may be deflected away from the shear edge 45 by doctor blade 46. While in pockets 43, the chips 12' are transferred by the rotor 40 to the outlet 20 of the housing 42. The chips are discharged, as indicated at 48, from the rotor 40 primarily by gravity. The gravity discharge may be assisted by a steam purge 47 introduced by conduits 21 and 22.

The gases in the outlet 20 may be unpressurized, but typically a pressure is maintained in the subsequent vessel (e.g. vessel 26, see FIG. 1), for example, a pressure of from about 0.5 to 3 bar (7 to 45 psi) gage. The prevailing conditions in the outlet 20 of the LPF 19 are preferably isolated and prevented from leaking to the inlet 18 by the mass of chips being conveyed and by the close clearance between the rotor 40 and the housing 42.

As described above, the chips 48 are typically discharged to another vessel for retention or further treatment. This vessel may be a conveying and treatment vessel, for example, a Steaming Vessel as sold by Ahlstrom Machinery, or it may be Chip Chute or Chip Tube also sold by Ahlstrom Machinery. That is, in certain installations, the treatment vessel 26 is unnecessary, for example in those installations where the bin 11 is a DIAMONDBACK® steaming vessel as described in U.S. Pat. No. 5,500,083; 5,617,975; 5,628,873; 4,958,741; and 5,700,355. In such installations the isolation device 19 may discharge directly to a conduit 30 and transfer device 31 (of FIG. 1).

Regardless of the device attached to the outlet 20 of isolation device 19, the outlet 20 typically contains malodorous gases, i.e. TRS-containing gases as described above. These gases will typically fill the empty pockets of the rotor after the chips have been discharged and can typically leak past the clearance between the rotor tines 41 and housing 42. In order to prevent these gases from reaching inlet 18 and interfering with the flow of chips into device 19, or interfering with the movement of material through device 16 or bin 11, an exhaust port 24 for TRS-laden exhaust 23 is included in housing 42. In some cases, this exhaust is fed to the bin 11 (see FIG. 1) which passes the gases via outlet 14 to an NCG collection system 14', or the exhaust 23 can be sent directly to a separate NCG collection system. However, for mills without an NCG collection system or an inadequate NCG collection system, the TRS-laden exhaust 23 can impact the amount of undesirable chemicals released to the environment.

Figure 3:
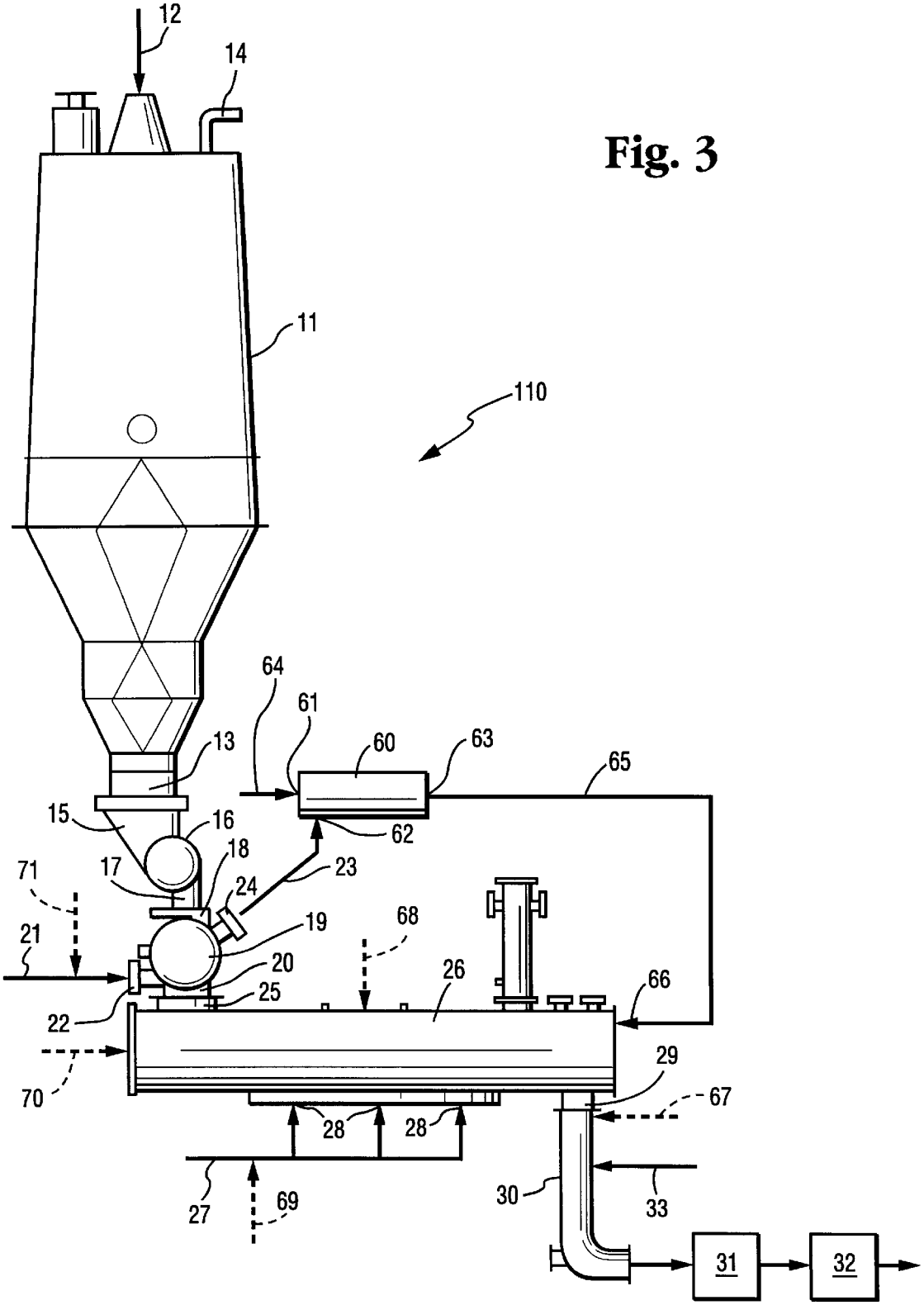
FIG. 3 is a view like that of FIG. 1 of an exemplary feed system according to the invention.

FIG. 3 illustrates one exemplary embodiment of the invention that addresses this problem. System 110 of FIG. 3 contains many if not all of the elements that appear in FIG. 1. Items 11 though 33 of FIG. 1 are essentially identical to items 11 through 33 of FIG. 3. However, according to the present invention, FIG. 3 also includes a venturi-type device 60, for example, a thermocompressor or eductor, for pressurizing the TRS-laden exhaust gases 23 from LPF 19. The preferred device used in the present invention is a thermocompressor.

The thermocompressor 60 may be a typical, commercially-available device having a high pressure inlet 61 a low pressure inlet 62 and a high-pressure outlet 63. Steam 64, or some other pressurized fluid (e.g. liquid), is introduced to the inlet 61 and passes through the conventional throat (not shown) of the thermocompressor 60. The low pressure, or vacuum created by the passage of the steam through the throat of the thermocompressor 60 draws the exhaust gasses 23 into the thermocompressor 60 and mixes them with the steam 64 prior to discharging them in stream 65 from outlet 63. The pressurized stream 65 can then be introduced wherever appropriate downstream of the isolation device 19. In one embodiment the stream 65 is introduced to the outlet end of vessel 26 at 66. However, this stream 65 containing exhausted gases from the isolation device 19 may also be introduced at locations 67, 68, 69, 70, 71, or combinations thereof. The pressure of the steam in conduit 65 is at least as great as the pressure in vessel 26.

Figure 4:
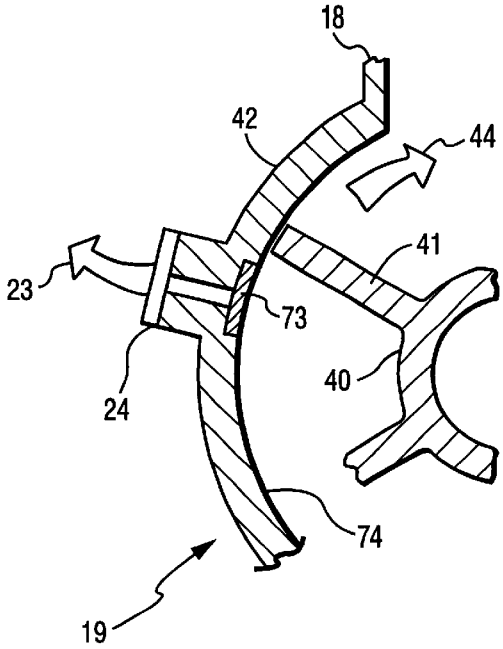
FIG. 4 is a detailed cross-sectional schematic view of a screen at the exhaust port of an exemplary low pressure feeder utilized in the system of FIG. 3.

The exhaust port 24 may include some form of screen 73 (see FIG. 4) to prevent the passage of chips, pins or fines out of the port 24. The screen 73 is preferably located along the internal surface 74 of the housing 42 so that the rotation of the rotor tines 41 creates a wiping action that helps to keep the screen 73 clear of pins, etc., that might block it.

Though any available source of steam may be used for steam 64, one preferred source of steam 64 is clean steam, that is, steam containing little or no malodorous, TRS compounds. However, the same source of steam introduced via conduit 27, that is, low-pressure steam obtained from flashed spent cooking liquor, may also be used as the steam 64.

Though device 60 is described as a venturi-type device for creating a vacuum, device 60 may alternatively be a conventional vacuum pump, compressor, thermocompressor, eductor, or ejector, among other comparable devices.

FIG. 5 illustrates one specific embodiment 210 of the invention shown in FIG. 3. FIG. 5 illustrates one method of modifying an existing exhaust steam collection system to implement the present invention. Many of the items shown in FIG. 5 are similar or identical to the items shown in FIG. 3. These items are identified with similar references numbers but, in FIG. 5, the reference numbers are prefaced by the numeral "1". For example, thermocompressor 160 in FIG. 5 provides the same function as thermocompressor 60 in FIG. 3.

The Steaming Vessel 126, Low Pressure Feeder 119, and Chip Meter 116 in FIG. 5 are essentially the same as the Steaming Vessel 26, Low Pressure Feeder (LPF) 19, and Chip Meter 16 in FIG. 3, though the orientation of the exhaust steam outlet 124 in FIG. 5 is different from the outlet of 24 in FIG. 3. Comminuted cellulosic fibrous material 112, typically wood chips, is introduced to the Chip Meter (or other metering device) 116, is passed through the Low Pressure Feeder 119 (or other pressure isolation device), then through the typically pressurized Steaming Vessel 126, and then passed to further treatment as shown by arrow 90. The chips 112 are typically steamed prior to being introduced to the Chip Meter 116, for example, in a Diamondback ( Bin (11 in FIG. 3) or conventional chip bin. The Steaming Vessel 126 typically includes a steam relief standpipe 105 for releasing air or non-condensable gases 106 that may build up in the vessel. These gases may be forwarded to an NCG collection and destruction system 14', for example, the gases 106 may be forwarded to a compressor and then to an NCG system 14'.

As is conventional, medium pressure steam, for example steam at about 60 psig, from source 91 is introduced to the LPF steam purge inlet 122 via conduit 121. Conduit 121 may include a valve 92, either manual or automatic, to regulate the flow of steam to the steam purge inlet 122. As is also conventional, exhaust steam exits the LPF 119 from exhaust outlet 124. In the conventional mode of operation the exhaust steam in conduit 123 is directed via conduit 93 to a Chip Bin 11, to an NCG collection system (see 14' in FIG. 1), or to atmosphere (for example, via an exhaust gas standpipe) via conduit 94. The flow of steam in conduits 93 and 94 is typically determined by one or more automatic or manual valves 98, 99 (typically on/off valves) having valve controllers 98', 99'.

However, according to one embodiment of the present invention, substantially all or at least some of the TRS-gas-laden steam in conduit 123 is directed via conduit 95 to the inlet 162 of thermocompressor 160. Conduit 95 may include a reducer 112, for example a 6"×4" reducer, if needed. The flow of steam in conduit 95 may be established by one or more manual or automatic valves (again, typically on/off valves) 100 having a valve controller 100'. Thermocompressor 160 is preferably a Graham Thermocompressor manufactured by Graham Manufacturing of Batavia, N.Y., though comparable thermocompressors, eductors, vacuum pumps, compressors, or their equivalents may be used. In the embodiment shown in FIG. 5, the Graham Thermocompressor is a 4"×6" stainless steel device having a 4" exhaust steam inlet 162, a 4" motive steam inlet 161, and a 6" combined steam outlet 163. The motive steam is provided to inlet 161 via conduit 164 from low pressure steam source 91. The flow of steam in conduit 164 may be regulated by one or more manual or automatic valves 96, 97 having a valve controller 97'. (This flow of steam in conduit 164 may also not be regulated by valves.) In this embodiment, the steam introduced to inlet 161 has a pressure of about 60 psig, and the combined steam discharged from outlet 163 has a pressure of about 17 psig. The pressurized combined steam containing TRS-gases from conduit 95 is introduced via 6" conduit 165 to the inlet 168 of Steaming Vessel 126. Note that, without providing further means of gas compression, the pressure of the combined steam in conduit 165 must have at least the pressure of the pressure present in Steaming Vessel 126, preferably a higher pressure. The pressure in vessel 126 typically ranges from 10 to 30 psig, more typically between 15 and 20 psig. The flow of steam in conduit 165 (e.g. between about 11–31 psig and at least one psig higher than in vessel 126, typically between about 20–25 psig) may be determined by one or more manual or automatic valves 104 (typically an isolation valve) having a valve controller 104'.

The system shown in FIG. 5 also includes one or more pressure monitoring (or indicating) devices (PI) 101,102, and 103 and flow indicators (FI) 107 in order to monitor and regulate the operation of the system.

The system shown in FIG. 5 also includes an automated valve control system to ensure the safe and proper operation of the system. For example, the system shown includes a hand switch (HS) controller 108 which monitors and controls the operation of valve controllers 98', 99',100', and 104', to monitor and control the operation of valves 98, 99, 100, and 104, via electronic control signals 298, 299, 200, 204. For example, controller 108 may typically be a computer-controlled system of ensuring that at least one of the valves 98, 99, or 100 is open, or that valve 104 is open when valve 100 is open before the system is allowed to operate. The system also preferably includes a hand-switch indicator and controller (HIC) 111 to control valve 97.

Thus, according to the present invention a method and apparatus for minimizing the escape of malodorous, TRS-laden gases from the feed system of a cellulose material treatment system are provided. While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims, and limited only by the prior art.

What is claimed is:

1. A method of minimizing the release of malodorous TRS-containing gases from a comminuted cellulosic fibrous material feed system, said method comprising:

(a) providing comminuted cellulosic fibrous material at a first pressure in the feed system and ultimately discharging the comminuted cellulosic material from the feed system;

(b) discharging malodorous gases from the feed system at a gas discharge point, substantially independently of the discharge of comminuted cellulosic fibrous material therefrom;

(c) pressurizing at least some of the malodorous gas discharged in (b) to increase the pressure thereof; and (d) re-introducing the pressurized gas from (c) into the flow of comminuted cellulosic material downstream of the gas discharge point.

2. A method as recited in claim 1 further comprising a treatment vessel downstream of the feed system; and wherein (d) is practiced by re-introducing the malodorous gases into the treatment vessel.

3. A method as recited in claim 2 wherein (c) is practiced to increase the pressure of the gases to between about 11–31 psig, and at least one psig higher than the pressure in the treatment vessel.

4. A method as recited in claim 1 wherein (c) is practiced using a thermocompressor, and introducing low pressure steam into the thermocompressor.

5. A method as recited in claim 4 further comprising a treatment vessel downstream of the feed system; and wherein (c) is practiced to increase the pressure of the gases to between about 11–31 psig, and at least one psig higher than the pressure in the treatment vessel.

6. A method as recited in claim 1 wherein (d) is practiced to reintroduce pressurized gas into the feed system, and (c) is practiced to increase the pressure by at least 2 psig.

7. A method as recited in claim 1 wherein (d) is practiced by discharging the material into a horizontal steaming vessel in the feed system.

8. A method as recited in claim 7 further comprising (e) steaming the material in the horizontal steaming vessel, and discharging steamed material from the horizontal steaming vessel from a bottom portion thereof; remote from the pressure isolation device; and (f) discharging malodorous gases from a top portion of the horizontal steaming vessel adjacent the bottom portion thereof from which the material is discharged; and (g) treating or disposing of the gases from (f) in an non-condensable gas system.

9. A method as recited in claim 1 further comprising a treatment vessel downstream of the feed system; and wherein (c) is practiced to increase the pressure of the gases to between about 11–31 psig, and at least one psig higher than the pressure in the treatment vessel.

10. A method of minimizing the release of malodorous TRS-containing gases from a comminuted cellulosic fibrous material feed system having a pressure isolation device with an inlet and outlet, and a treatment vessel connected to the outlet, said method comprising:

(a) introducing comminuted cellulosic fibrous material at a first pressure to the inlet of the pressure isolation device;

(b) transferring the material to the outlet of the pressure isolation device at a second pressure, higher than the first pressure;

(c) discharging the material from the pressure isolation device to the treatment vessel;

(d) discharging malodorous gases from the pressure isolation device substantially independently of the discharge of comminuted cellulosic fibrous material therethrough;

(e) pressurizing at least some of the malodorous gases discharged in (d) to increase the pressure thereof; and (f) re-introducing the pressurized malodorous gases into the flow of comminuted cellulosic material downstream of the pressure isolation device.

11. A method as recited in claim 10 wherein (f) is practiced by re-introducing the malodorous gases into the treatment vessel connected to the outlet of the pressure isolation device.

12. A method as recited in claim 10 wherein (e) is practiced using a thermocompressor or an eductor, and introducing steam into the thermocompressor or eductor.

13. A method as recited in claim 12 wherein (c) is practiced by discharging the material into a horizontal steaming vessel and wherein (f) is practiced by re-introducing the malodorous gases into the horizontal steaming vessel.

14. A method as recited in claim 13 further comprising (g) steaming the material in the horizontal steaming vessel, and discharging steamed material from the horizontal steaming vessel from a bottom portion thereof remote from the pressure isolation device; (h) discharging malodorous gases from a top portion of the horizontal steaming vessel adjacent the bottom portion thereof from which the material is discharged; and (i) treating or disposing of the gases from (h) in an non-condensable gas system.

15. A method as recited in claim 10 further comprising screening the gases passing out of the pressure isolation device during (d) to substantially prevent the passage of chips, pins, or fines out of the pressure isolation device with the malodorous gases.

16. A method of minimizing the release of malodorous TRS-containing gases from a comminuted cellulosic fibrous material feed system having a star-type feeder with an inlet and outlet, said method comprising:

(a) introducing comminuted cellulosic fibrous material at a first pressure to the inlet of the star-type feeder;

(b) rotating the star-type feeder, so as to transfer the material to the outlet of the star-type feeder at a second pressure, higher than the first pressure;

(c) discharging the material from the star-type feeder outlet;

(d) discharging malodorous gases from the star-type feeder substantially independently of the discharge of comminuted cellulosic fibrous material therefrom;

(e) pressurizing substantially all of the malodorous gases discharged in (d) to increase the pressure thereof; and (f) introducing the pressurized malodorous gases from (e) into the flow of comminuted cellulosic material downstream of the star-type feeder.

17. A method as recited in claim 16 wherein (c) is practiced by discharging the material from the star-type feeder outlet to a treatment vessel operatively connected to the outlet, and wherein (f) is practiced by introducing the malodorous gases into the treatment vessel.

18. A method as recited in claim 16 wherein (e) is practiced using a thermocompressor or an eductor, and introducing steam into the thermocompressor or eductor.

19. A method as recited in claim 16 further comprising screening the gases passing out of the star-type feeder during (d) to substantially prevent the passage of chips, pins, or fines out of the pressure isolation device with the malodorous gases.

20. A method of minimizing the release of malodorous TRS-containing gases from a comminuted cellulosic fibrous material feed system, said method comprising:

(a) providing comminuted cellulosic fibrous material at a first pressure in the feed system and ultimately discharging the comminuted cellulosic material from the feed system;

(b) discharging malodorous gases from the feed system at a gas discharge point, substantially independently of the discharge of comminuted cellulosic fibrous material therefrom;

(c) pressurizing substantially of the malodorous gas discharged in (b) to increase the pressure thereof by at least 2 psig and to between about 11–31 psig; and (d) re-introducing the pressurized gas from (c) into the flow of comminuted cellulosic material downstream of the gas discharge point.

21. A method as recited in claim 20 wherein (d) is practiced by discharging the material into a horizontal steaming vessel and feed system; and further comprising (e) steaming the material in the horizontal steaming vessel, and discharging steamed material from the horizontal steaming vessel from a bottom portion thereof; remote from the pressure isolation device; and (f) discharging malodorous gases from a top portion of the horizontal steaming vessel adjacent the bottom portion thereof from which the material is discharged; and (g) treating or disposing of the gases from (f) in a non-condensable gas system.

22. A method as recited in claim 20 wherein (c) is practiced using a thermocompressor, and introducing low pressure steam into the thermocompressor; and further comprising screening the gases passing out of the pressure isolation device during (b) to substantially prevent the passage of chips, pins, or fines out of the pressure isolation device with the malodorous gases.

* * * * *